US006231316B1

(12) United States Patent
Wakisaka et al.

(10) Patent No.: US 6,231,316 B1
(45) Date of Patent: May 15, 2001

(54) SCROLL-TYPE VARIABLE-CAPACITY COMPRESSOR

(75) Inventors: Takeshi Wakisaka, Nagoya; Shigeki Iwanami, Okazaki; Keiichi Uno, Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/343,018

(22) Filed: Jun. 29, 1999

(30) Foreign Application Priority Data

Jul. 1, 1998 (JP) ..... 10-186241

(51) Int. Cl.[7] ..... F04B 49/00
(52) U.S. Cl. ..... 417/310
(58) Field of Search ..... 417/212, 213, 417/310, 440

(56) References Cited

U.S. PATENT DOCUMENTS 5,451,146 * 9/1995 Inagaki et al. ..... 417/310
5,885,063 * 3/1999 Makino et al. ..... 417/310

FOREIGN PATENT DOCUMENTS 9-296787 11/1997 (JP) .

* cited by examiner

*Primary Examiner*—Timothy S. Thorpe
*Assistant Examiner*—W. Rodriguez
(74) *Attorney, Agent, or Firm*—Pillsbury Winthrop LLP

(57) ABSTRACT

A scroll-type variable-capacity compressor is disclosed in which a single spool is moved to open or close bypass ports and thereby change the capacity of compression chambers. Especially, the capacity can be controlled in satisfactory manner by opening the bypass ports to a specific position. Specifically, a first bypass port is arranged in the neighborhood of the contact point between the inner surface of the spiral wall of a fixed scroll and the outer surface of the spiral wall of a movable scroll making up one of the compression chambers with the capacity thereof reduced to a predetermined level. A second bypass port is arranged at a position on the side beyond a discharge port from the first bypass port but where the discharge port is not located on the line connecting the particular position and the first bypass port. The opening of the second bypass port is arranged at such a position as to be closed by the spiral wall of the movable scroll defining the other compression chamber in the state described above.

15 Claims, 11 Drawing Sheets

SCROLL-TYPE VARIABLE-CAPACITY COMPRESSOR

BACKGROUND OF THE INVENTION

1. Field of the Invention

The present invention relates to a scroll-type variable-capacity compressor suitably used as a refrigerant compressor for an automotive air-conditioning system, for example.

2. Description of the Related Art

A conventional scroll-type compressor is known in which a fixed scroll engages a movable scroll and the refrigerant is compressed in a pair of compression chambers formed between the fixed scroll and the movable scroll. Another compressor of this type is known which further comprises a bypass port operated for changing the capacity. In a scroll-type compressor disclosed in Japanese Unexamined Patent Publication (Kokai) No. 9-296787, for example, a bypass port is opened or closed when a pair of compression chambers are located at an equivalent position under a state of a changing capacity.

SUMMARY OF THE INVENTION

The object of the present invention is to provide a scroll-type compressor with the capacity thereof changed by opening or closing bypass ports communicating with a pair of compression chambers, wherein the bypass ports are selectively located at an optimum open position. Specifically, the Japanese Unexamined Patent Publication (Kokai) No. 9-296787 quoted above describes only that a pair of bypass ports are located at an equivalent position but fails to disclose the position where the bypass ports are closed at the same time that the pair of the compression chambers reach a predetermined capacity. The bypass ports illustrated in the same patent publication appear to open to the neighborhood of the spiral wall of a fixed scroll. In actual operation, therefore, a pair of the bypass ports communicating with a pair of the compression chambers are not in such relative positions as to open or close at the same time.

The present invention has been developed by the present inventors based on a unique study, as described later, and provides a scroll-type variable-capacity compressor in which a pair of bypass ports open to a pair of compression chambers respectively are opened or closed by moving a single valve spool thereby to change the capacity, or especially the bypass ports are open to a specific position.

More specifically, a first bypass port is arranged in the inner surface of the spiral wall of a fixed scroll in the neighborhood of a contact point (X) between the inner surface of the spiral wall of the fixed scroll and the outer surface of the spiral wall of the movable scroll constituting compression chambers in the state where the capacity is to be controlled, i.e. in the state where the volume of the compression chambers is reduced to a predetermined level.

A second bypass port is opened to the side of the discharge port far from the first bypass port in such a position that the discharge port is not located on the line connecting the second bypass port and the first bypass port. The opening of the second bypass port is of course located at a position adapted to be closed by the spiral wall of the movable scroll defining the compression chambers reaching the predetermined capacity described above.

According to a second aspect of the invention, the second bypass port is formed at an angular position leading the contact point (Y) between the outer surface of the spiral wall of the fixed scroll and the inner surface of the spiral wall of the movable scroll.

According to a third aspect of the invention, in contrast, the second bypass port is formed at an angular position retarded from the contact point (Y).

According to a fourth aspect of the invention, the first bypass port and the second bypass port are closed substantially at the same time by the spiral wall of the movable scroll so that the two compression chambers have substantially the same compression ratio.

According to a fifth aspect of the invention, the first bypass port and the second bypass port has a timing, slightly displaced from each other, when the conduction of the first bypass port and the second bypass port with the compression chamber is blocked by the movable scroll, with the result that the compression ratios of the two compression chambers are slightly different from each other.

According to a sixth aspect of the invention, a third bypass port is formed which conducts only in the initial stage of starting compression of the compression chambers. This configuration is useful when the second bypass port is arranged at an angular position leading the contact point (Y) as in the second aspect of the invention.

According to a seventh aspect of the invention, the third bypass port has a smaller opening area than the first and second bypass ports.

According to an eighth aspect of the invention, the bypass ports are formed as round holes to facilitate the machining.

According to a ninth aspect of the invention, a plurality of bypass ports are formed, thereby increasing the opening area of the bypass ports as a whole and thus facilitating the outflow of the refrigerant from the compression chamber to the bypass ports.

According to a tenth aspect of the invention, the bypass ports are arcuate in shape extending along the involute curve of the spiral wall of the movable scroll, thereby increasing the opening area of the bypass ports and facilitating the outflow of the refrigerant.

According to an 11th aspect of the invention, the diameter of the bypass ports is not larger than the thickness of the spiral wall of the movable scroll, thereby permitting the bypass ports to be blocked positively by the spiral wall of the movable scroll.

According to 12th and subsequent aspects of the invention, the position and shape of the bypasses and the spool for opening and closing the bypass ports are specifically defined. Especially in a 13th aspect of the invention, the bypass has a larger sectional area than the bypass ports, thereby having a buffer effect on the refrigerant flow and preventing pressure pulsations.

BRIEF DESCRIPTION OF THE DRAWINGS

The above and other objects, features and advantages will be made apparent by the detailed description taken in conjunction with the accompanying drawings, in which.

DESCRIPTION OF THE PREFERRED EMBODIMENTS

Now, an embodiment of the present invention will be explained with reference to the drawings.

Figure 1:
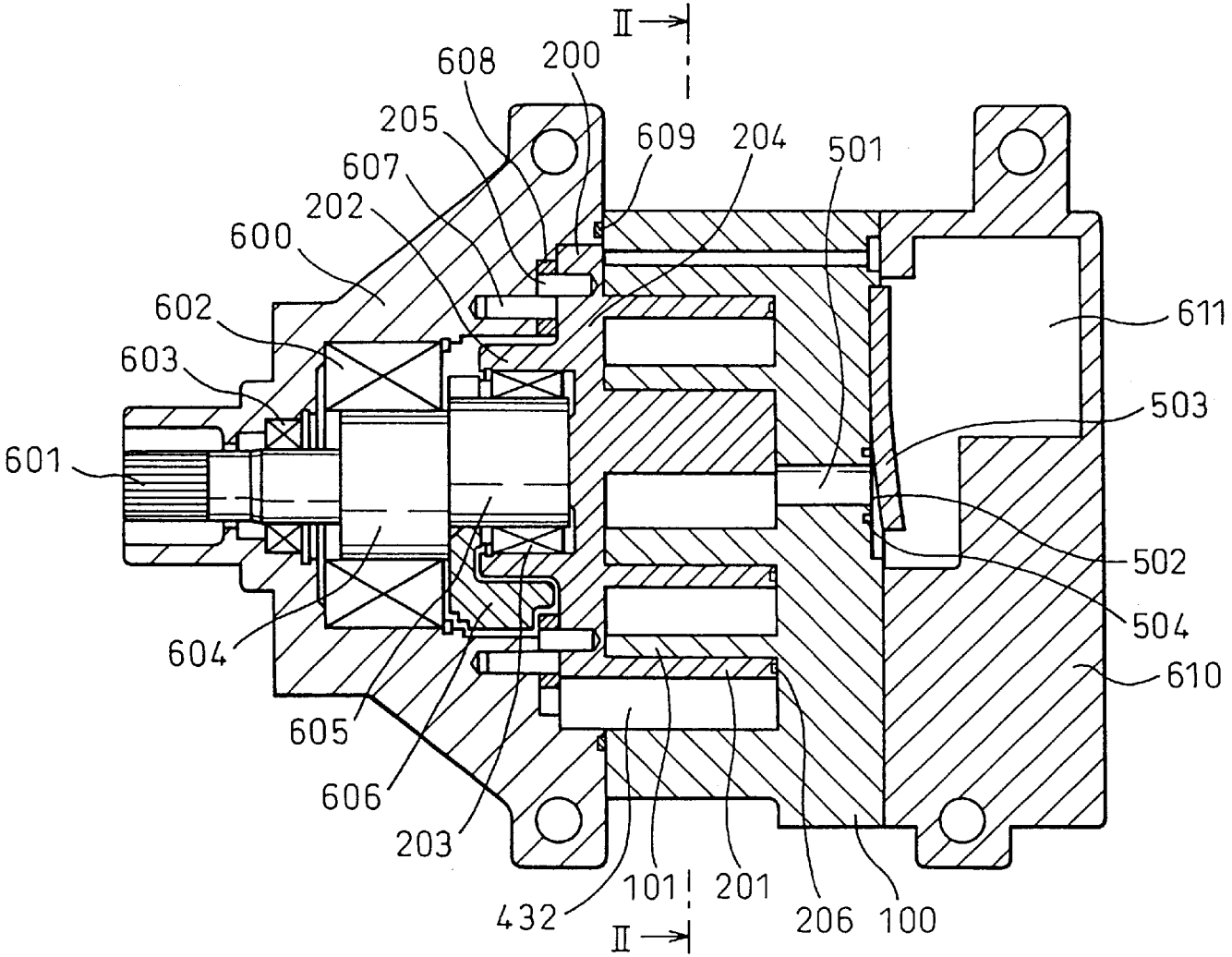
FIG. 1 is a longitudinal sectional view showing a specific embodiment of the scroll-type compressor according to the present invention.

FIG. 1 is a longitudinal sectional view of a scroll-type compressor used as a refrigerant compressor for an automotive air-conditioning system. In FIG. 1, reference numeral 600 designates a front housing made of an aluminum alloy, in which a shaft 601 is rotatably supported on a bearing 602. The shaft 601 receives the rotative driving force of an automobile engine through an electromagnetic clutch not shown and rotates within the housing 600. Thus, the rotational speed of the shaft 601 changes with the rotational speed of the automobile engine.

Numeral 603 designates a shaft seal for sealing the interior of the housing, which shaft seal is held by the housing 600.

The part of the shaft 601 opposed to the bearing 602 constitutes a large-diameter portion 604. Further, an eccentric portion 605 is formed behind the large-diameter portion 604. Numeral 606 designates a balancer for correcting the rotational unbalance due to the eccentricity of the eccentric portion 605. The eccentric portion 605 rotatably engages a boss portion 202 of a movable scroll 200 through a bearing 203.

Pins 205 are pressure fitted in a base plate 304 of the movable scroll. Each pin 607 adjacent to the corresponding one of the pins 205 is pressure fitted in the housing 600. Each pair of the pins 205, 607 are mutually restricted by a ring 608. The ring 608 and the two pins 205, 607 prevents the rotation of the movable scroll 200. In other words, the pins 205, 607 and the ring 608 form an anti-rotation mechanism for the movable scroll 200.

Thus, the turning effort of the eccentric portion 605 of the shaft 601 is transmitted as the orbiting motion of the movable scroll 200, so that the movable scroll 200 orbits without rotation.

Figure 5:
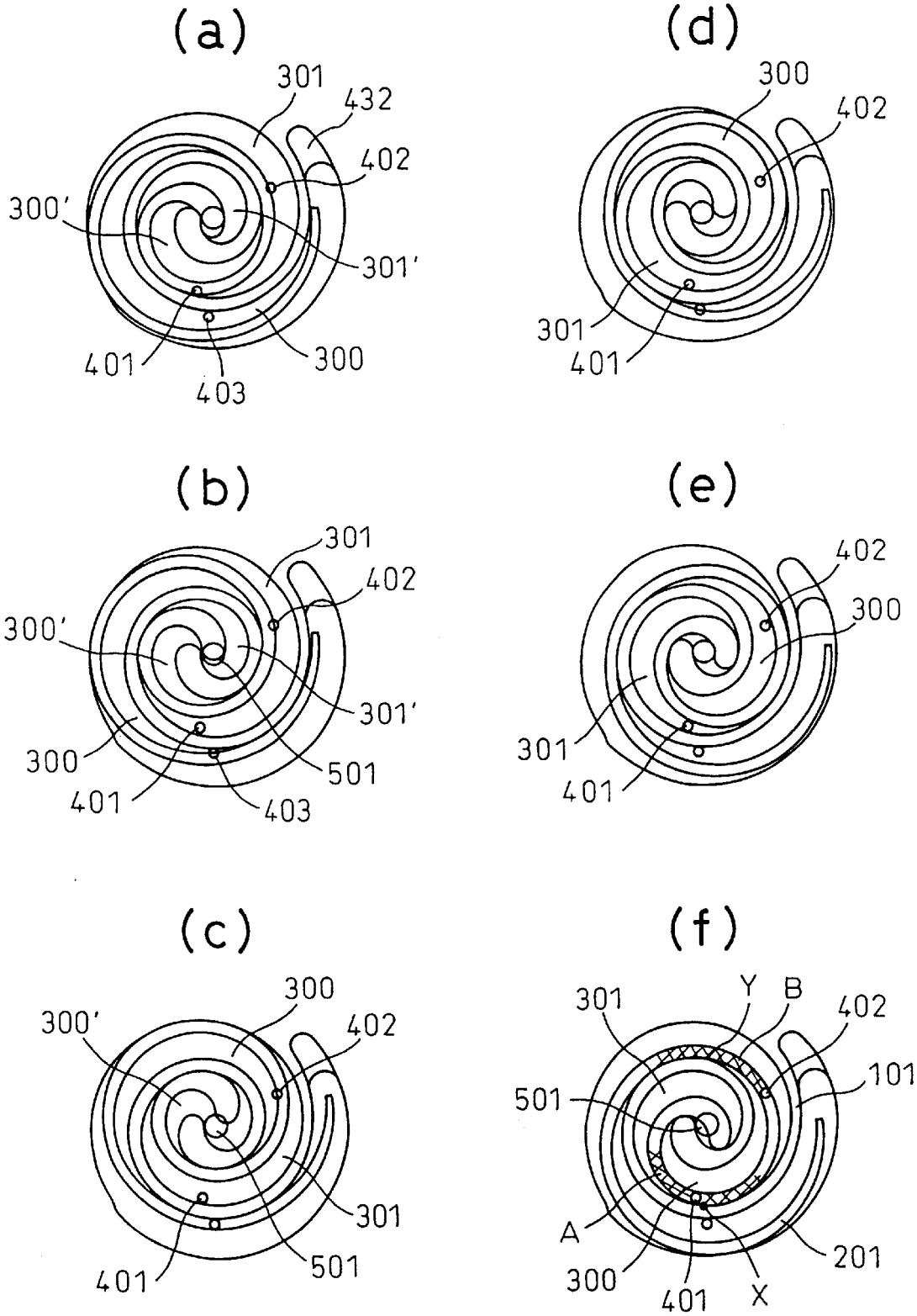
FIG. 5 shows transition states (a) to (f) of the movable scroll of a scroll-type compressor according to the invention or, especially, (a) to (f) of FIG. 5 are cross sectional views for explaining the opening positions of the bypass ports.

Numeral 100 designates a fixed scroll engaging a spiral wall 201 of the movable scroll 200. The engagement between the spiral wall 101 of the fixed scroll and the spiral wall 201 of the movable scroll is shown in FIG. 5 and described later. The fixed scroll 100 is also made of an aluminum alloy. The spacing outside the spiral walls 101, 201 of the fixed scroll 100 and the movable scroll constitute an intake pressure chamber (intake chamber) 432 which receives a low-pressure refrigerant through an intake port not shown. The spacing between the fixed scroll 100 and the housing 600 is sealed with an O-ring 609.

A discharge port 501 is opened at the central portion of the fixed scroll 100. A discharge valve 502 is arranged in such a position as to cover the discharge port 501. The discharge valve 502 is held by a stopper 503 so as not to be extremely deformed. Numeral 504 designates an annular groove for improving the hermeticity of the discharge valve 502. A rear housing 610 is arranged at the back of the fixed scroll 100. A discharge chamber (discharge pressure chamber) 611 constituting a part of the passage of the refrigerant discharged by way of the discharge port 501 is formed in the rear housing 610.

Figure 2:
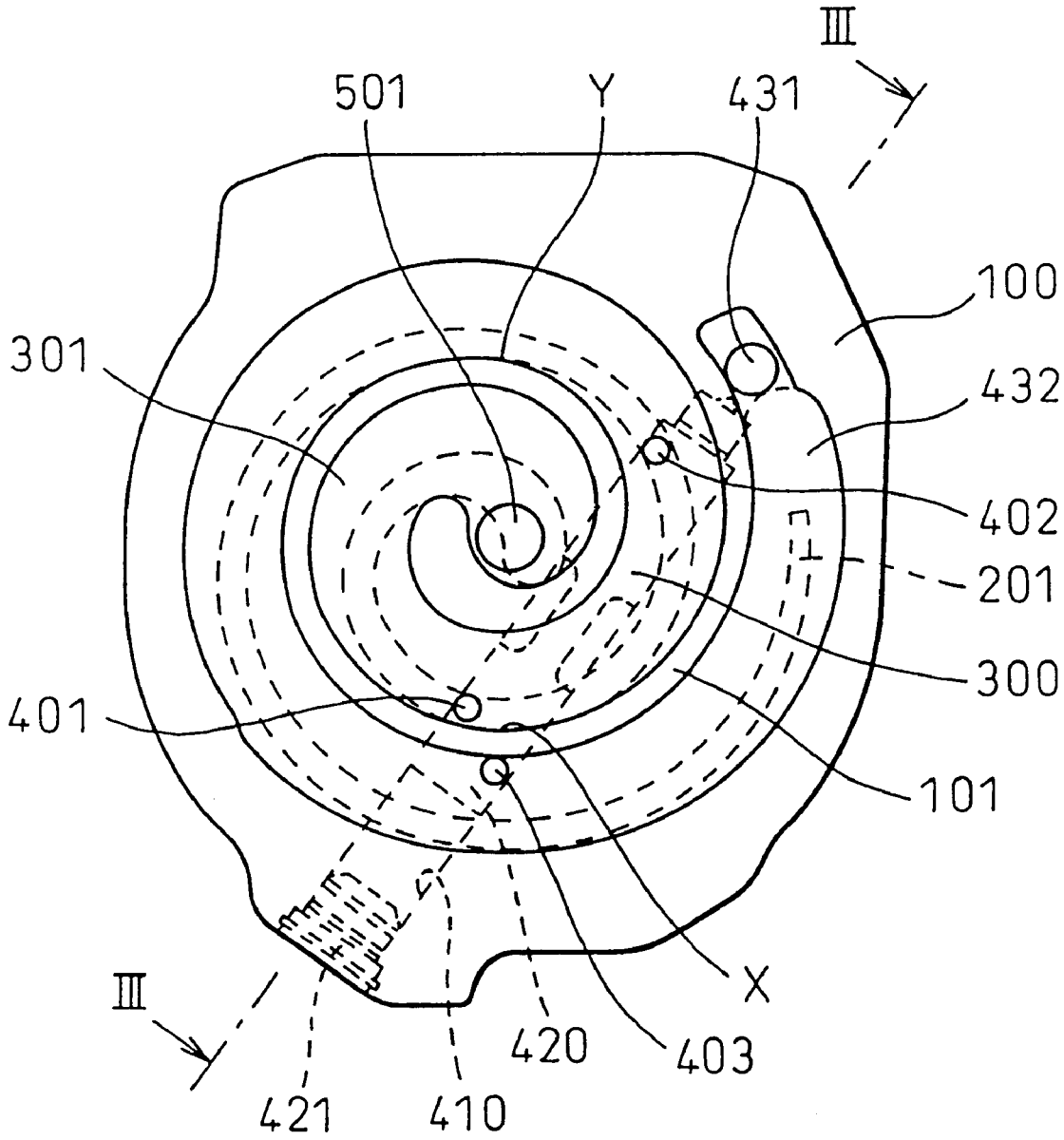
FIG. 2 is a cross sectional view taken in line II—II in FIG. 1.

FIG. 2 is a cross sectional view taken in line II—II in FIG. 1 and shows that the discharge port 501 opens to the central portion of the fixed scroll 100 as described above. The spiral wall 101 of the fixed scroll is formed in a position surrounding the discharge port 501. In FIG. 2, the spiral wall 201 of the movable scroll is indicated by dashed line. This diagram indicates the movable scroll 201 in a position where the volume of a pair of compression chambers 300, 301 formed between the spiral walls 101, 102 of the two scrolls is equivalent to a predetermined capacity as large as 50% of the initial value, for example. In other words, FIG. 2 corresponds to the state of (f) of FIG. 5 described later.

The first bypass port 401 is formed at a position inside of the spiral wall 101 of the fixed scroll in the neighborhood of the contact point X between the inner surface of the spiral wall 101 of the fixed scroll and the outer surface of the spiral wall 201 of the movable scroll, where the compression chambers 300, 301 have reached the predetermined capacity described above and also where the first bypass port 401 is adapted to be closed by the end surface of the spiral wall 201 of the movable scroll. According to this embodiment, the first bypass port 401 is a round hole easily to be machined, and has a width (diameter) not more than the width (thickness) of the spiral wall 201 of the movable scroll.

A tip seal 206 is arranged at the forward end of the spiral wall 201 of the movable scroll for sealing the gap with the fixed scroll 100 (FIG. 1). The diameter of the first bypass port 401 is slightly larger than the width of the tip seal 206.

This is in order to reduce the flow resistance of the refrigerant pushed back toward the intake port from the bypass port and reduce the power loss by increasing the diameter of the bypass port as much as possible. In the case where the characteristic of the compressor requires the elimination of the leakage from the bypass port, however, the diameter of the bypass port is set to the same as or slightly smaller than the width of the tip seal 206.

The second bypass port 402 is formed at a position advanced a predetermined amount from the position Y which is in point symmetry with the contact X located on the other side of the discharge port 501. In the embodiment shown in FIG. 2, the second bypass port 402 is at a position advanced by about 30 degrees. The position Y in point symmetry with the contact X constitutes also a contact point between the outer surface of the spiral wall 101 of the fixed scroll and the inner surface of the spiral wall 201 of the movable scroll when the compression chambers 300, 301 reach a predetermined capacity.

According to this embodiment, the second bypass port 402 is advanced a predetermined angle from the contact point Y, so that the line connecting the first bypass port 401 and the second bypass port 402 is displaced from the discharge port 501.

Also, according to this embodiment, a third bypass port 403 is formed on the side of the spiral wall 101 of the fixed scroll far from the first bypass port 401.

Figure 3:
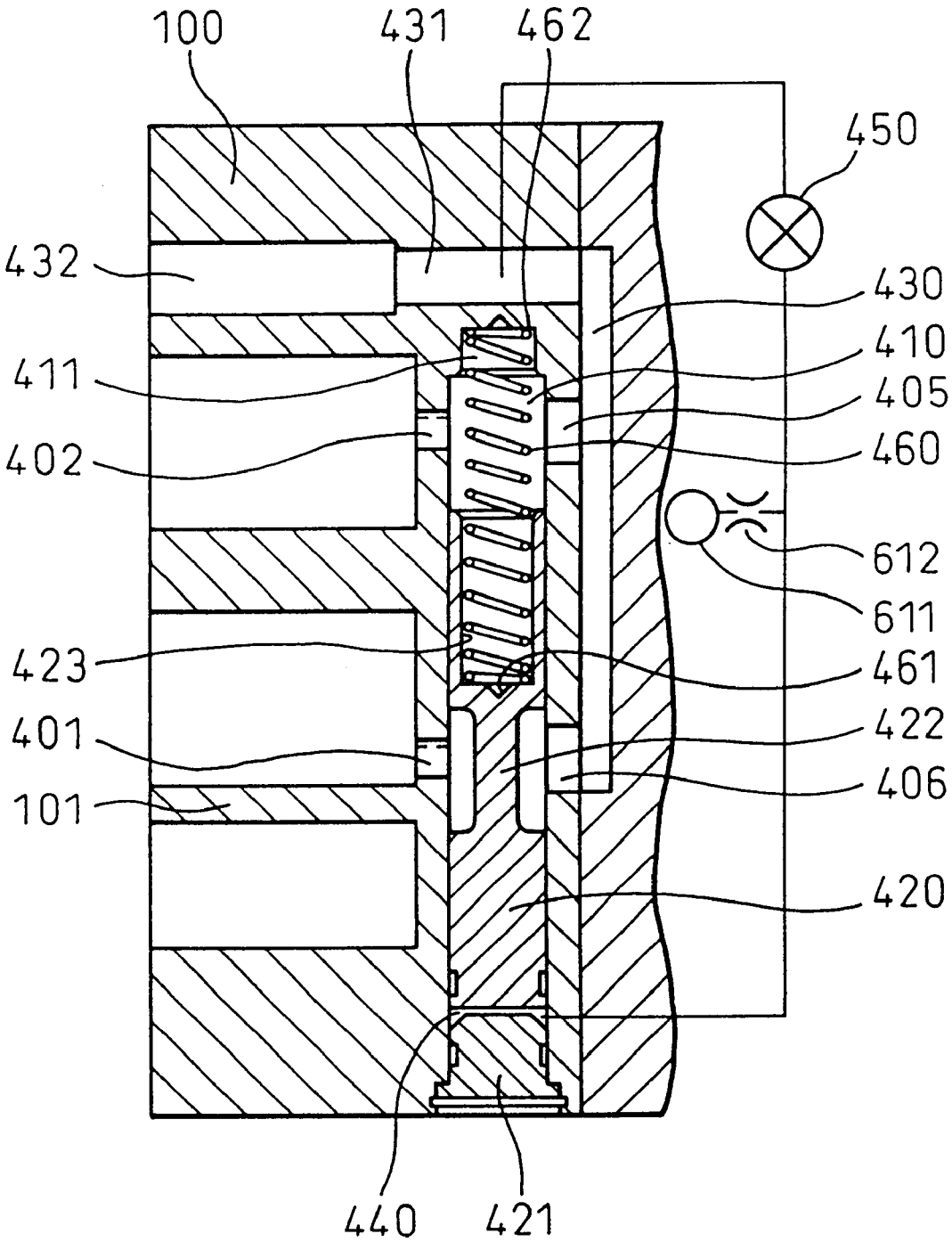
FIG. 3 is a longitudinal sectional view taken in line III—III FIG. 2.

In the embodiment shown in FIG. 2, the first bypass port 401, the second bypass port 402 and the third bypass port 403 all constitute round holes. A bypass 410 is formed in opposed relation to all of the first to third bypass ports 401, 402, 403. The bypass 410 is formed as a long hole having a circular section, and has slidably arranged therein a valve spool 420. In FIG. 2, numeral 421 designates a cap for sealing the open end of the bypass 410. FIG. 3 is a sectional view taken in line III—III in FIG. 2. As shown in FIG. 3, the spool 420 has a cylindrical form of the same diameter as the bypass 410 and has a small-diameter central portion.

The fixed scroll 100 has opened thereto a bypass port 405 communicating with the bypass 402 through the bypass 410, a bypass port 406 communicating with the bypass port 401 through the bypass 410, and a bypass port not shown in FIG. 3 communicating with a bypass port 403 through the bypass 410. Each of the bypass ports 405, 406 communicates with a return bypass 430 formed between the fixed scroll 100 and the rear housing 610. Further, the return bypass 430 communicates with an intake pressure chamber 432 located on the outermost periphery of the spiral wall 101 of the fixed scroll through a passage 431 of the fixed scroll 100. In this embodiment, as shown in FIG. 2, the passage 431 is opened to a position displaced further toward the outer periphery than the outermost end of the spiral wall 201 of the movable scroll.

As shown in FIG. 3, a control pressure chamber 440 defined by the spool 420 and the cap 421 is supplied with the control pressure controlled by the control valve 450. Also, a coil spring 460 is arranged on the side of the spool 420 far from the control pressure chamber 440. The control spring 460 presses the spool 420 against the control pressure chamber 440.

The spool 420 is formed with a cylindrical hole 423 to support the coil spring 460. An end 461 of the coil spring 460 is held in the hole 423. Also, an end of the bypass 410 is formed with a small-diameter portion 411, and the other end of the coil spring 460 is held in the small-diameter portion 411.

The control valve 450 described above appropriately controls the intake pressure and the discharge pressure of the compressor and, by thus introducing the pressure into the control pressure chamber 440, changes the internal pressure of the control pressure chamber 440. Specifically, as shown in FIG. 3, the control pressure chamber 440 and the discharge pressure chamber 611 communicate with each other through a restrictor 612. As a result, the high pressure from the discharge pressure chamber 611 is supplied to the control pressure chamber 440. The passage connecting the restrictor 612 and the control pressure chamber 440, on the other hand, communicates with the intake pressure chamber 432 through the control valve 450. In the case where the control valve 450 opens, therefore, part of the high-pressure refrigerant flows from the discharge chamber 611 into the intake pressure chamber 432. Especially, the leakage of the refrigerant from the discharge chamber 611 is reduced by the restrictor 612. When the control valve 450 opens, therefore, the pressure of the intake pressure chamber 432 has a greater effect on the control pressure chamber 440 than the pressure of the discharge pressure chamber 611. Consequently, when the control valve 450 opens, the internal pressure of the control pressure chamber 440 drops to a level almost equal to the intake pressure.

Figure 12:
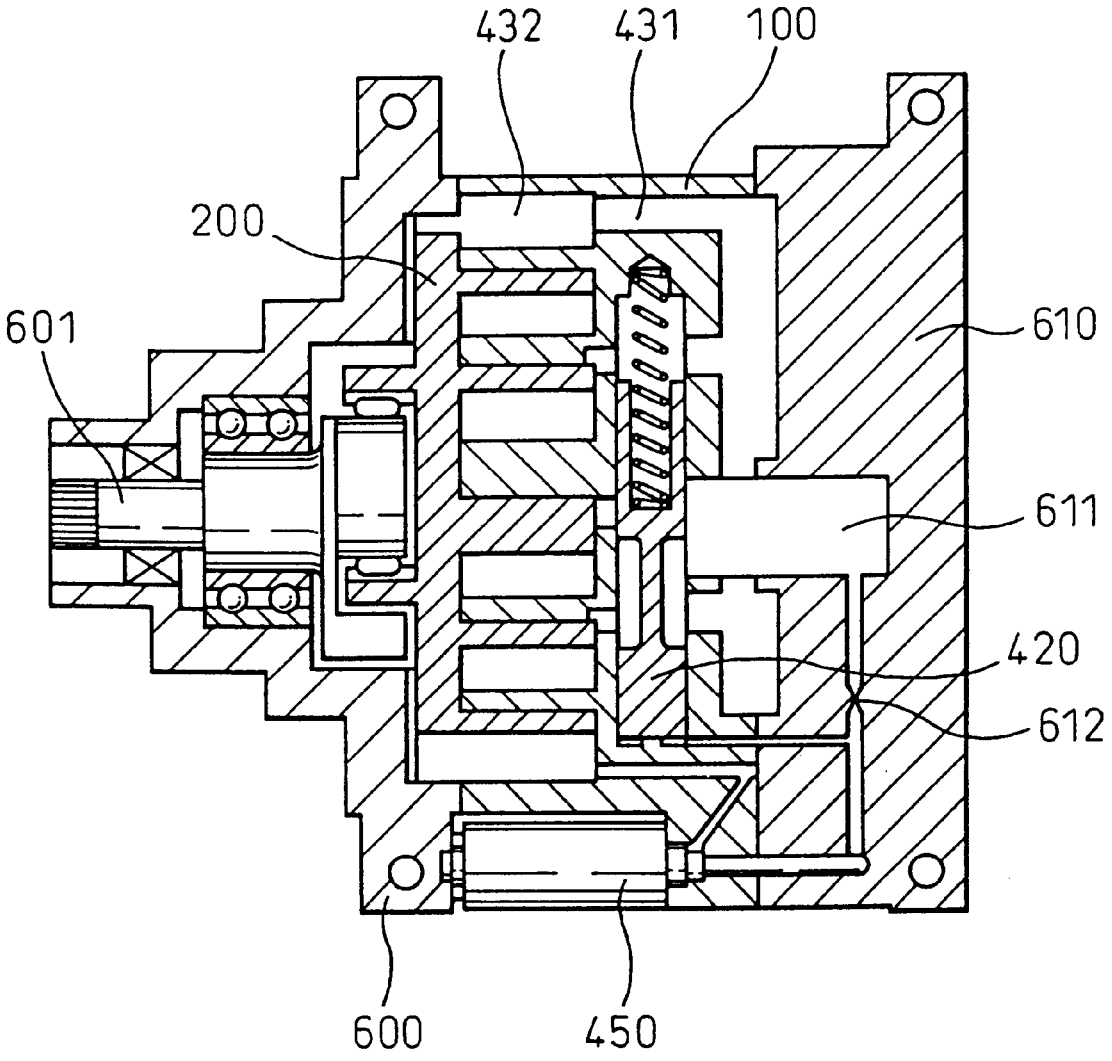
FIG. 12 is a longitudinal sectional view showing the arrangement of a control valve according to the invention.

As shown in FIG. 12, the control valve 450 can be arranged on the side of the fixed scroll 100 in the form held between the front housing 600 and the rear housing 610. In the embodiment shown in FIG. 12, a passage for leading the signal pressure to the control valve 450 is formed in the rear housing 610. The signal pressure passage, however, can alternatively be formed as a groove in a gasket interposed between the fixed scroll 100 and the rear housing 610.

As shown in FIG. 3, the other end (upper end) of the valve spool 420 is adapted to receive the pressure from the intake pressure chamber 432 through the bypass port 405, the return bypass 430 and the passage 431. With the control valve 450 open, therefore, the differential pressure between the portions above and below the spool 420 is small. Also, the spool 420 is energized by the coil spring 460. Under the uniform pressure, therefore, as shown in FIG. 3, the spool 420 is energized by the coil spring 460 and shifts toward the control pressure chamber 440 to the maximum amount. Under this condition, the land portion (constituting a valve) of the upper end of the spool 420 opens the bypass port 402. At the same time, the bypass port 401 is faced and opened by the central small diameter portion 422 (constituting the other valve) of the spool 420. As a result, the first bypass port 401 communicates with the bypass port 406 through the spacing around the small diameter portion 422 of the spool 420, and further communicates with the intake chamber 432 formed on the outer peripheral side of the spiral walls of the two scrolls through the return bypass 430 and the passage 431. In similar fashion, the second bypass port 402 communicates with the bypass port 405 through the spacing in the bypass 410, and further communicates with the intake side through the return bypass 430 and the passage 431.

As described above, when the control valve 450 is open, the first bypass port 401, the second bypass port 402 and, though not shown in FIG. 3, the third bypass port 403 are all opened.

Figure 4:
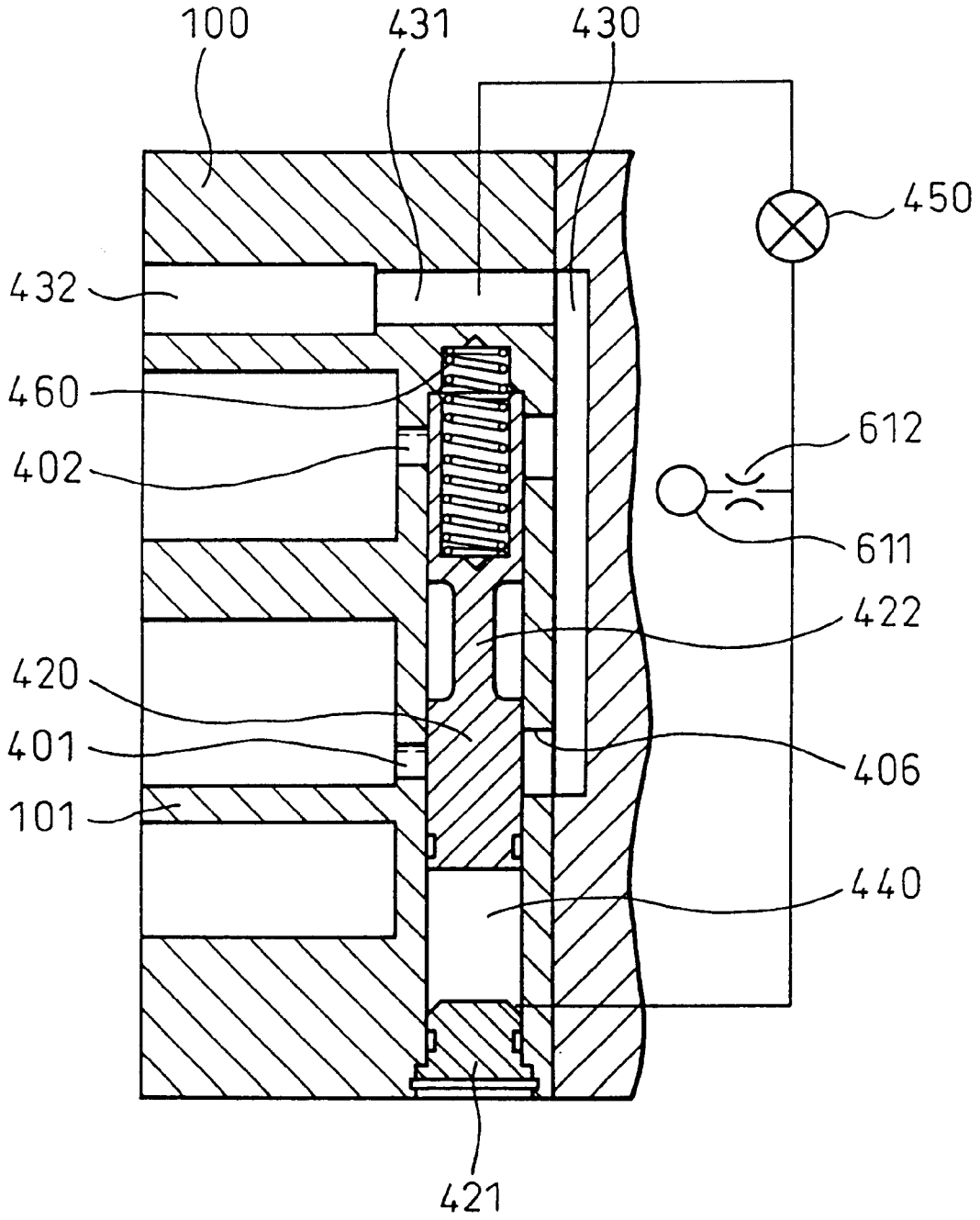
FIG. 4 is the same sectional view as FIG. 3 for explaining the transition of the spool.

FIG. 4 shows the control valve 450 in closed state. In this case, the communication between the control pressure chamber 440 and the intake pressure chamber 432 is cut off. As a result, the high-pressure refrigerant in the discharge pressure chamber 611 is supplied to the control pressure chamber 440 in a small amount at a time through the restrictor 612. The internal pressure of the control pressure chamber 440 thus increases quickly. When the internal pressure of the control pressure chamber 440 rises beyond the energization force of the coil spring 460, the spool 420 shifts upward in FIG. 4 by compressing the coil spring 460. Thus, the first bypass port 401, the second bypass port 402 and, though not shown in FIG. 4, the third bypass port 403 are all closed by the valve spool 420.

Now, an explanation will be given of the opening positions of these bypass ports 401, 402, 403 formed on the base plate of the fixed scroll 100. The manner in which the capacity of a pair of the compression chambers 300 and 301 of the scroll-type compressor undergoes a change is shown in (a) to (f) of FIG. 5. The compression chambers 300 and 301 shown in (f) of FIG. 5 have a volume 50% smaller than the volume of the compression chambers 300 and 301 (shown in (a) of FIG. 5) in intake stroke. As a result, if the bypass ports 401, 402 are arranged at a position where the bypass ports 401, 402 are not closed until the volume is reduced to 50%, for example, the capacity of the scroll-type compressor can be switched to 100% or 50% by opening or closing the bypass ports. Taking the first bypass port 401 as an example, this bypass port 401 can be arranged at a position where it is closed by the spiral wall 201 of the movable scroll in the state of (f) of FIG. 5. This position corresponds to the hatched area A in (f) of FIG. 5. In the embodiment shown in FIG. 5, therefore, the bypass port 401 is opened to a position adjacent to the contact point X ((f) of FIG. 5) between the spiral wall 101 of the fixed scroll and the spiral wall 201 of the movable scroll.

Each stage of (a) to (f) of FIG. 5 will be explained taking note of the relation between the compression chamber 301 and the first bypass port 401. In stage (a), the bypass port 401 opens to the compression chamber 301. In similar fashion, in stages (b) to (e), the bypass port 401 opens to the compression chamber 301. Under these conditions, therefore, as long as the valve (the small diameter portion 422 of the spool 420) of the bypass port 401 is kept open, the refrigerant compressed in the compression chamber 301 flows out (from the intake pressure chamber 432) by way of the bypass port 401. In other words, under these conditions, the compression chamber 301 is prevented from compressing the refrigerant by keeping open the valve of the bypass port 401.

The bypass port 401 is not closed by the end surface of the spiral wall 201 of the movable scroll until stage (f) of FIG. 5. Under this condition, therefore, the refrigerant cannot flow out of the compression chamber 301 from the bypass port 401 even if the valve of the bypass port 401 is open.

The state in which the volume is further reduced from the stage of (f) in FIG. 5 is shown as a compression chamber 301' in (a) of FIG. 5. As is clear from (a) of FIG. 5, when the volume of the compression chamber 301' is further reduced, the communication between the compression chamber 301' and the bypass port 401 is impossible from the viewpoint of mechanism thereof. With a further reduction in the volume of the compression chamber 301' to the stage of (b) of FIG. 5, the discharge valve opens and the compressed refrigerant is discharged from the discharge port 501.

Taking note of the compression chamber 301, therefore, assume that the bypass port 401 is arranged so that when a predetermined capacity is reached, it can be closed by the spiral wall 201 of the movable scroll at a position inside of the spiral roll 101 of the fixed scroll among the contact points between the spiral wall 101 of the fixed scroll and the spiral wall 201 of the movable scroll. Then, the capacity of the compression chamber 301 can be controlled by the operation of the bypass port 401.

Figure 6:
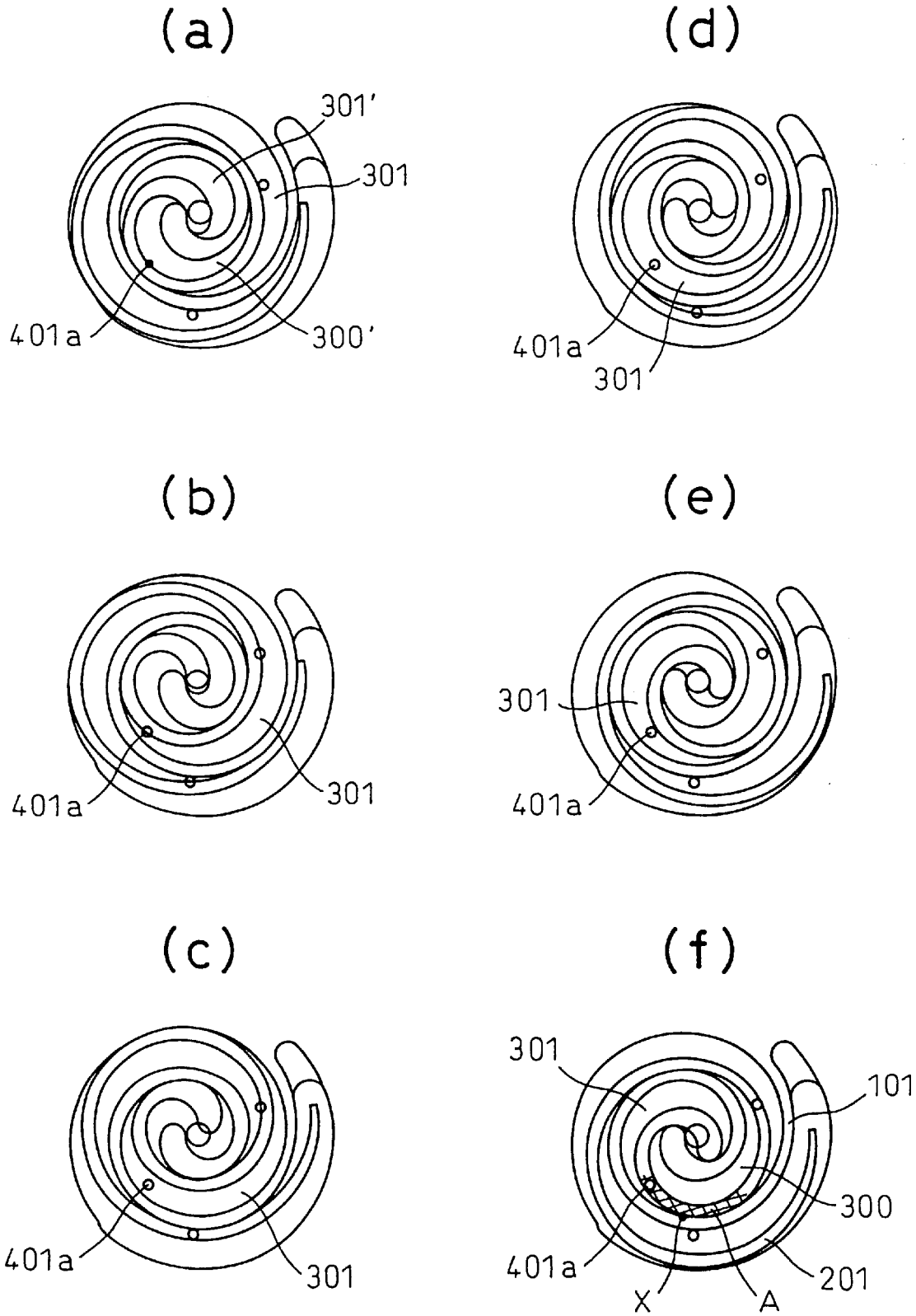
FIG. 6 shows transition states (a) to (f) of the movable scroll similar to FIG. 5 or, especially, (a) to (f) of FIG. 6 are cross sectional views for explaining the opening positions of the bypass ports.

The same effect can be obtained also when the bypass port 401 is arranged at another position in the area A shown in (f) of FIG. 5 different from the position shown in FIG. 5 in the example described above. FIG. 6 is a diagram similar to FIG. 5 and shows the capacity change of the compression chambers 300 and 301 of the scroll-type compressor. In FIG. 6, (f) shows the case in which the capacity is 50%. In FIG. 6, therefore, the bypass port 401*a* is open to the position in the area A advanced from the bypass port 401 in FIG. 5.

In the example of FIG. 6, the compression chamber 301, the bypass port 401*a* is open to the compression chamber 301 in state (b) while the bypass port 401*a* is kept open to the compression chamber 301 in states (c) to (e). Before state (f), the bypass port 401*a* is not closed by the spiral wall 201 of the movable scroll nor leaves the compression chamber 301.

Accordingly, regarding the compression chamber 301 alone, the opening position of the bypass port 401*a* is not necessarily limited to the neighborhood of the contact point between the spiral wall 101 of the fixed scroll and the spiral wall 201 of the movable scroll, but can be advanced from the particular contact point as shown in FIG. 6.

In this state, however, it can be seen from (a) of FIG. 6 that the bypass port 401*a,* though at a distance from the compression chambers 301, 301', undesirably communicates with the compression chamber 300'. The capacity of the compression chamber 300' is smaller than the capacity (50%) of the compression chamber shown in (f) of FIG. 6. Under this condition, therefore, although the compression occurs in the compression chamber 301', the refrigerant still leaks from the bypass port 401*a* and the compression would be made impossible in the compression chamber 300'.

Specifically, under this condition, the compression cannot be effected in the compression chamber 300' but only in the compression chamber 301'. The result is an unbalance between the compression chambers 300' and 301', thereby making impossible a compression operation at a predetermined capacity. It can thus be ascertained that the opening position of the bypass port 401*a* extremely advanced from the contact point X between the spiral wall 101 of the fixed scroll and the spiral wall 201 of the movable scroll is not desirable.

Now, an explanation will be given of the case in which the bypass port 401*b* is open to a position in the area A retarded from the contact point X between the spiral wall 101 of the fixed scroll and the spiral wall 201 of the movable scroll.

Figure 7:
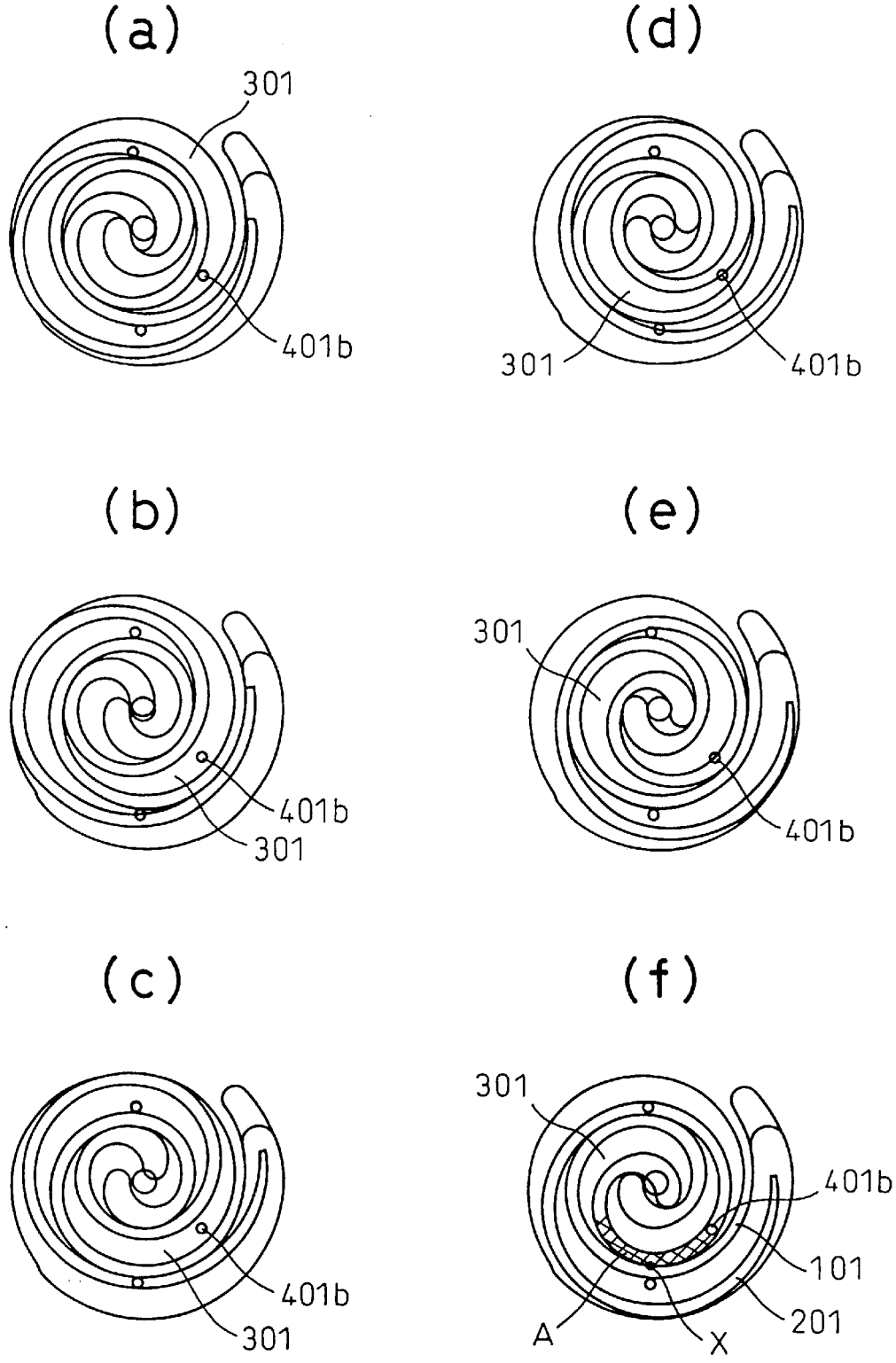
FIG. 7 shows transition states (a) to (f) of the movable scroll similar to FIG. 5 or, especially, (a) to (f) of FIG. 7 are cross sectional views for explaining the open state of the bypass ports.

FIG. 7 shows the state in which the bypass port 401*b* is open to a position retarded from the contact point X. As shown in (f) of FIG. 7, the bypass port 401*b* leaves the compression chamber 301 and is closed by the spiral wall 201 of the movable scroll when the compression chamber 301 reaches a predetermined capacity (50%).

The operation under each state will be explained with reference to (a) to (f) of FIG. 7. In the states (a) to (f), the compression chamber 301 is connected with the bypass port 401*b*. In these states, therefore, the compression of the refrigerant in the compression chamber 300 can be prevented by opening the valve of the bypass port 401*b*.

In the case where the bypass port 401*b* is opened to a position retarded from the contact point X between the spiral wall 101 of the fixed scroll and the spiral wall 201 of the movable scroll, however, the bypass port 401*b* is separated from the compression chamber 301 by the spiral wall 201 of the movable scroll in state (e) of FIG. 7 before the capacity of the compression chamber 301 is reduced to state (f) of FIG. 7.

In other words, in the case where the position of the bypass port 401*b* is retarded from the contact point X, the compression begins undesirably before the capacity of 50% as shown in (f) of FIG. 7, for example. Thus, the capacity of the compressor cannot be controlled to an initially intended value.

As described above, it has been ascertained that the opening position of the bypass port 401 is desirably in the neighborhood of the contact point X between the spiral wall 101 of the fixed scroll and the spiral wall 201 of the movable scroll for the desired capacity.

Taking into consideration the fact that a pair of the compression chambers 300, 301 move in point symmetry, the position of the bypass port 402 for the compression chamber 300 is desirably in point symmetry with the position of the bypass port 401.

In the case where the bypass port 402 and the bypass port 401 are formed at positions in point symmetry with each other, however, the line connecting the bypass ports 401 and 402 passes through the center of the spiral wall of the scroll. The discharge port 501 opens to the central portion of the spiral wall 101 of the fixed scroll. An attempt to open or close the two bypass ports 401 and 402 with a single spool valve, therefore, would unavoidably cause the spool to face the discharge port 501. The result would be that the flow of the refrigerant discharged from the discharge pot 501 is undesirably blocked by the spool operating the bypass ports 401, 402.

In view of this, according to this invention, the other bypass port 402 is opened at a position displaced from the position in point symmetry.

The position of the second bypass port 402 will be explained with reference to FIG. 5. In (f) of FIG. 5, the compression chambers 300 and 301 are shown to have a predetermined capacity (50%), and an area adjacent to the contact point Y between the inner surface of the spiral wall 201 of the movable scroll and the outer surface of the spiral wall 101 of the fixed scroll is shown as a hatched portion B. In FIG. 5, the bypass port 402 is opened to a position in the area B advanced from the contact point Y. Regarding the relation between the compression chamber 300 and the bypass port 402, the bypass port 402 is opened to the compression chamber 300 in the states of (c) to (e) of FIG. 1. As a result, with the valve of the bypass port 402 open, the refrigerant in the compression chamber 300 flows out of the bypass port 402, so that the refrigerant is not compressed in the compression chamber 300. The communication between the compression chamber 300 and the bypass port 402 is not shut by the spiral wall 201 of the movable scroll before the stage of (f) in FIG. 5.

Subsequently, the compression chamber 300 is further compressed and the capacity thereof is decreased as indicated by the numerical character 300' in (a) to (c) of FIG. 5. In the meantime, the compression chamber 300' does not communicate with the bypass port 402, but the refrigerant is further compressed and the refrigerant thus compressed is discharged from the discharge port 501 in the state of (c) in FIG. 5.

Specifically, the compressor shown in FIG. 5 does not develop any inconvenience in which the bypass port 402, after being closed, comes to communicate again with the compression chamber 300 or 301 which has been further compressed (i.e. the inconvenience of the bypass port 401*a* as shown in FIG. 6). In the state (a) or (b) in FIG. 5, however, the bypass port 402 fails to communicate with the compression chamber 300. Regarding the bypass port 402 alone, therefore, it is not before state (c) of FIG. 5 that the bypass port 402 comes to communicate with the compression chamber 300 and the refrigerant that has slightly increased in pressure in the compression chamber 300 flows out into the bypass port 402.

As described above, even in the case where the refrigerant that has slightly increased in pressure has flowed out through the bypass port 402, no problem is posed for the control of the discharge capacity of the compressor as a whole since the refrigerant in the compression chamber 300 begins to be compressed in and after state (f) in FIG. 5. Nevertheless, the pulsation of the pressure of the discharged refrigerant occurs. Therefore, an auxiliary port 403 constituting the third port described above is desirably arranged to alleviate such pressure pulsation. This auxiliary port 403 opens to a position communicating with the compression chamber 300 in the states of (a) and (b) in FIG. 5. As a result, the refrigerant in the compression chamber 300 does not increase in pressure even in the state of (c) in FIG. 5. Therefore, the refrigerant can be continuously and smoothly discharged from the bypass port 402.

Figure 8:
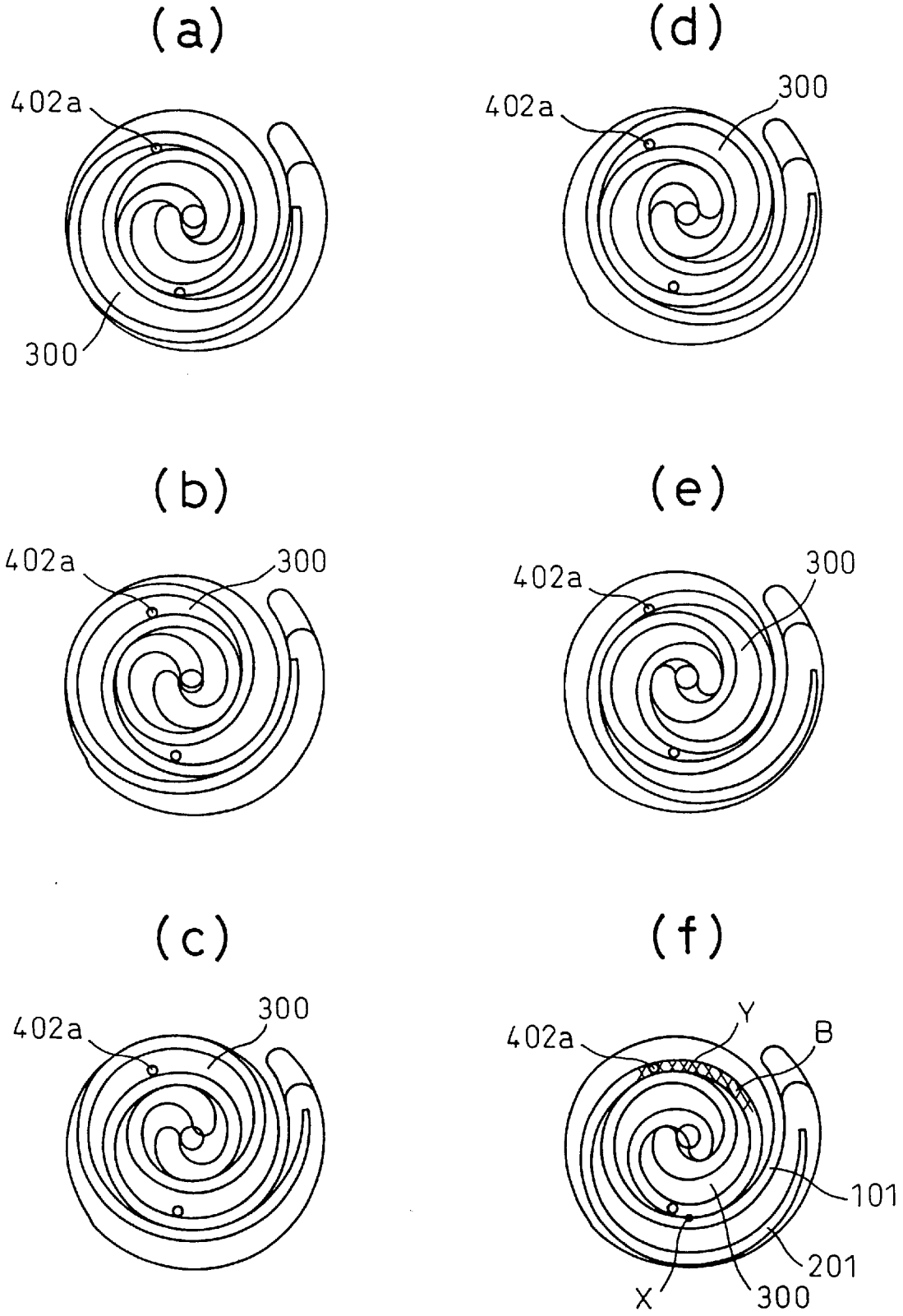
FIG. 8 shows transition states (a) to (f) of the movable scroll similar to FIG. 5 and (a) to (f) of FIG. 8 are cross sectional views for explaining the open state of the bypass ports.

Unlike the embodiment of FIG. 5 in which the bypass port 402 is opened to a position advanced from the contact port 402*a*, the embodiment of FIG. 8 is such that the bypass port 402*a* opens to a position retarded from the contact point Y between the inner surface of the spiral wall 201 of the movable scroll and the spiral wall 101 of the fixed scroll in the area B defined by the spiral wall 201 of the movable scroll in the state where the compression chamber 300 reaches a predetermined capacity (50%).

Taking note of the relation between the compression chamber 300 and the bypass port 402*a*, the bypass port 402*a* opens to the compression chamber 300 in any of the states (a) to (e) of FIG. 8. As far as the valve of the bypass port 402*a* opens in this state, therefore, the refrigerant flows out of the compression chamber 300 toward the bypass port 402*a*. Then the bypass port 402*a* is not closed by the spiral wall 201 of the movable scroll and the compression is not started before the state (f) of FIG. 8.

As shown in (e) of FIG. 8, the opening area of the bypass port 402*a* decreases as compared with the other bypass port 401. Specifically, the communication between the bypass port 402*a* and the compression chamber 300 is blocked earlier than the predetermined state shown in (f) of FIG. 8. The resulting effect is small, however, as compared with the state in which the bypass port 401*b* is retarded from the contact point X as shown in FIG. 7.

Figure 9:
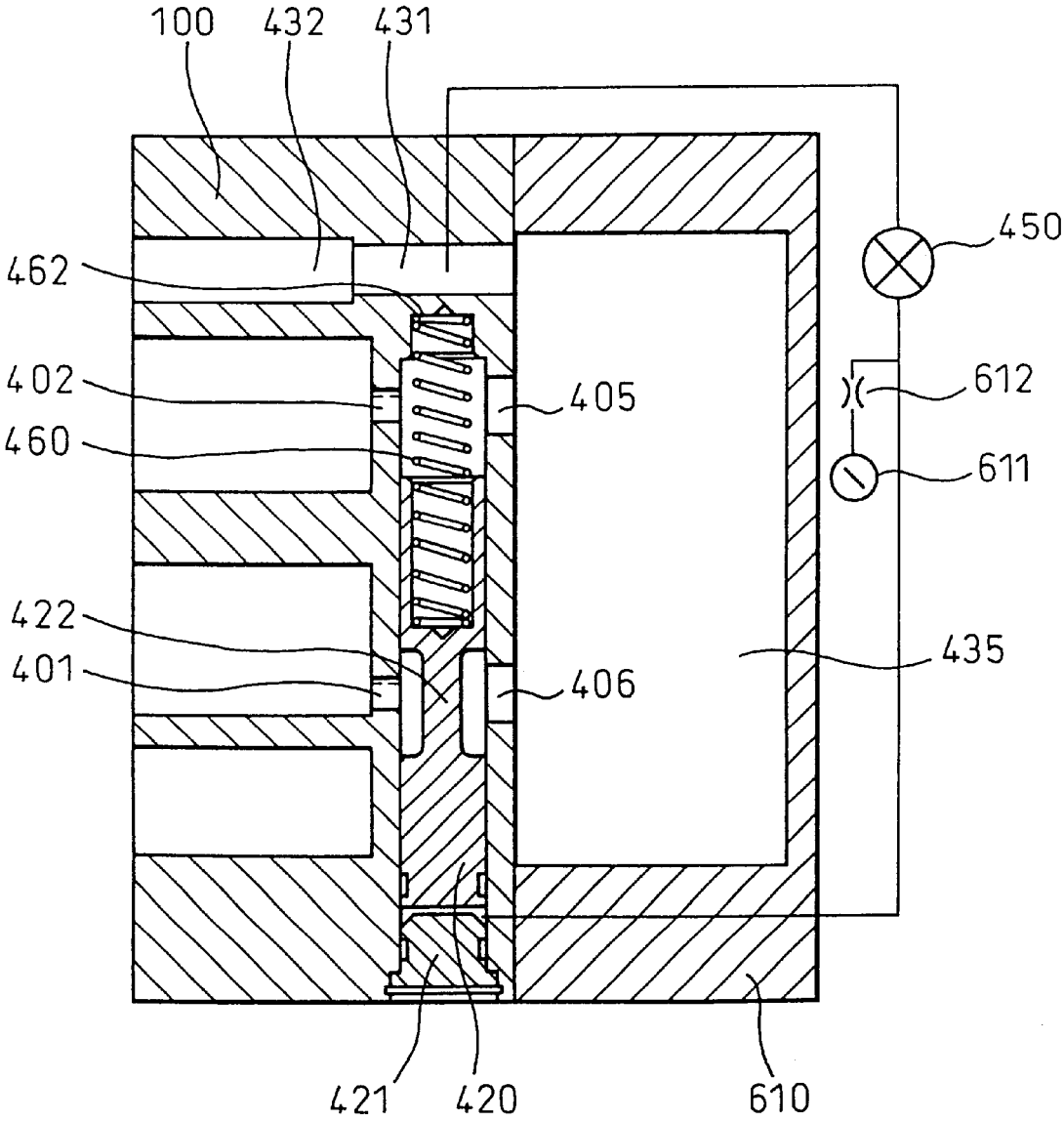
FIG. 9 is a longitudinal sectional view showing a bypass according to another embodiment of the invention.

In FIGS. 3 and 4, the return bypass 430 is shown as a grooved passage formed between the fixed scroll 100 and the rear housing 610. As an alternative, as shown in FIG. 9, a bypass communication passage may formed with a sufficiently large space to be utilized as a buffer chamber 435. The buffer chamber 435 shown in FIG. 9 covers substantially the whole width (thickness) of the rear housing 610, and the sectional area of the passage is much larger than the bypass port 405 or the bypass port 406.

If the control valve 450 is opened and the spool 420 shifts under the pressure of the coil spring 460 so that the first port 401, the second port 402 and the third port (auxiliary port) 403 not shown have opened, the refrigerant that flows from each of these bypass ports through the return bypass to the intake pressure chamber 432 provisionally stays in the buffer chamber 435 constituting an enlarged return bypass.

As explained with reference to FIG. 5, even when any one of the bypass ports opens to the compression chamber while the valve of the particular bypass port is open, the internal capacity of the compression chamber sequentially changes with the orbiting motion of the movable scroll 200, with the result that the refrigerant flowing through the bypass ports 401, 402, etc. to the intake pressure chamber 432 also pulsates. In comparison with this, the configuration shown in FIG. 9 in which the buffer chamber 435 constitutes a return bypass can attenuate the pulsation of the refrigerant flow through the bypass.

Figure 10:
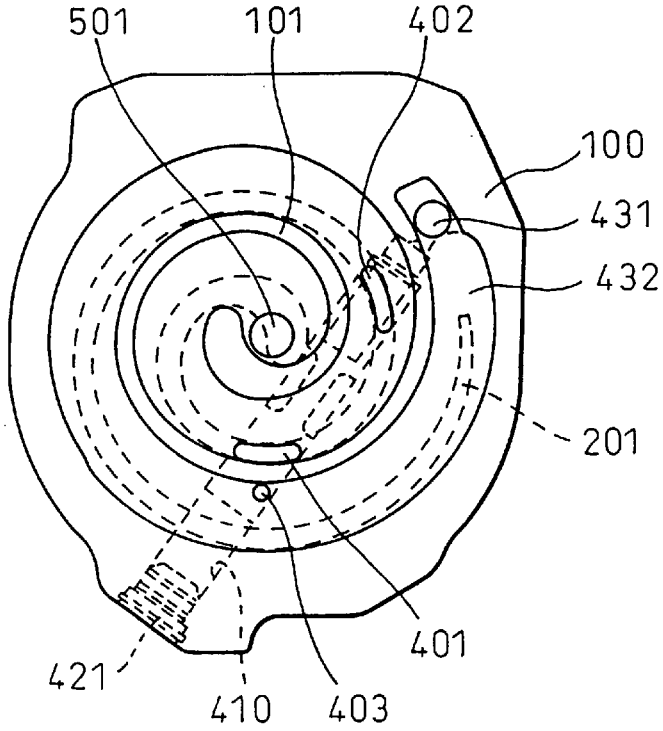
FIG. 10 is a cross sectional view showing the shape of the bypass port according to another embodiment of the invention for explaining the section at the same position as in FIG. 6.

In the embodiments described above, the first bypass port 401 and the second bypass port 402 are both formed as a round hole. Alternatively, the bypass ports 401 and 402 may be a long hole as shown in FIG. 10. In such a case, each long hole is so shaped to have substantially the same width as the spiral wall 201 of the movable scroll in an arcuate form along the involute curve of the spiral wall of the movable scroll.

Figure 11:
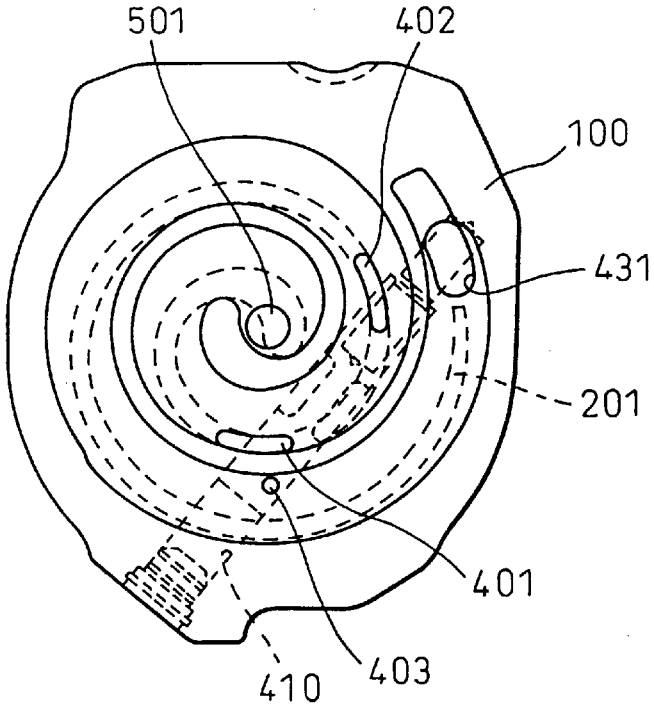
FIG. 11 is a cross sectional view showing the shape of the bypass port according to still another embodiment of the invention for explaining the section at the same position as n FIG. 6.

In the embodiment of FIG. 10, the longitudinal width (length) of the long holes 401, 402 is limited within the range of the bypass 410. As shown in FIG. 11, however, the bypass ports 401, 402 may be displaced somewhat from the bypass 410. Even in such a case, the bypass port 401 or 402 can be closed as far as the land surface of the spool 420 faces the bypass port 401 or 402, as the case may be.

The opening area of the bypass ports can be increased by forming a long hole of the bypass ports 401, 402. As a result, the flow resistance of the refrigerant flow from the compression chamber to the bypass 410 can be reduced and so the internal compression can be reduced when the compressor is operated with a small capacity.

Of course, the bypass port 401 is not limited to the round hole shown in FIG. 2 or the long hole shown in FIG. 10, but may be formed of a hole including a plurality of round holes combined, for example.

The present invention is not confined to the embodiments shown and explained in detail above but can be embodied in various ways without departing from the scope of the claims appended hereto.

What is claimed is:

1. A scroll-type variable-capacity compressor comprising:

a fixed scroll including a flat base plate and a spiral wall formed to protrude from said base from said base plate;

a movable scroll including a flat base plate and a spiral wall formed to protrude from said base plate, said movable scroll engaging said fixed scroll thereby to form at least a pair of compression chambers opposite to each other;

an intake pressure chamber formed as a spacing outside of said movable scroll for supplying a compressing gas into said pair of compression chambers;

a discharge port formed at the central portion of said fixed scroll for discharging the gas compressed in said pair of said compressor chambers;

a first bypass port arranged in said base plate of said fixed scroll and adapted to establish the communication between one of said pair of compression chambers and said intake pressure chamber;

a second bypass port arranged in said base plate of said fixed scroll and adapted to establish the communication between the other one of said pair of compression chambers and said intake pressure chamber; and a valve spool configured for opening and closing said first bypass port and said second bypass port simultaneously;

wherein said first bypass port is formed at a position adjacent to the inner surface of said spiral wall of said fixed scroll within an area on said base plate of said fixed scroll which is closed by said spiral wall of said movable scroll only after said one of said pair of compression chambers is reduced to a predetermined capacity, and said second bypass port is formed at a position on the side beyond said discharge port from said first bypass port within said area closed by said spiral wall of said movable scroll only after said other one of said pair of compression chambers is reduced to said predetermined capacity, said second bypass port being set in such a position that a line connecting said first bypass port and said second bypass port is displaced from said discharge port.

2. A scroll-type variable-capacity compressor according to claim 1, wherein said second bypass port is formed forward of the line connecting said first bypass port and said discharge port in the direction of movement of said movable scroll.

3. A scroll-type variable-capacity compressor according to claim 1, wherein said second bypass port is formed rearward of the line connecting said first bypass port and said discharge port in the direction of movement of said movable scroll.

4. A scroll-type variable-capacity compressor according to claim 1, wherein the compression ratio of said one of said compression chambers closed with said spiral wall of said movable scroll facing said first bypass port coincides with the compression ratio of said other compression chamber closed with said spiral wall of said movable scroll facing said second bypass port.

5. A scroll-type variable-capacity compressor according to claim 1, wherein the compression ratio of said one of said compression chambers closed with said spiral wall of said movable scroll facing said first bypass port is different by an amount not more than a very small amount from the compression ratio of said other compression chamber closed with said spiral wall of said movable scroll facing said second bypass port.

6. A scroll-type variable-capacity compressor according to claim 1, further comprising a third bypass port for establishing communication between at least one of said compression chambers and said intake pressure chamber at a position on the side beyond said spiral wall of said fixed scroll from said first bypass port on the surface of said base plate of said fixed scroll where said third bypass port can be closed by said valve spool.

7. A scroll-type variable-capacity compressor according to claim 6, wherein the opening area of said third bypass port is smaller than the opening area of said first bypass port.

8. A scroll-type variable-capacity compressor according to claim 1, wherein said first bypass port and said second bypass port are formed of a round hole.

9. A scroll-type variable-capacity compressor according to claim 1, wherein at least one of said first bypass port and said second bypass port is formed of a plurality of holes.

10. A scroll-type variable-capacity compressor according to claim 1, wherein at least one of said first bypass port and said second bypass port has an arcuate form extending along the shape of said spiral wall of said movable scroll.

11. A scroll-type variable-capacity compressor according to claim 1, wherein a tip seal member is arranged at the end surface of said spiral wall of said movable scroll thereby to seal the gap between said spiral wall of said movable scroll and said base plate of said fixed scroll, and wherein the width of said first bypass port and said second bypass port is larger than the width of said tip seal member and smaller than the thickness of said spiral wall of said movable scroll.

12. A scroll-type variable-capacity compressor comprising:

a fixed scroll including a flat base plate and a spiral wall formed to protrude from said base plate;

a movable scroll including a flat base plate and a spiral wall formed to protrude from said base plate, said movable scroll engaging said fixed scroll thereby to form at least a pair of compression chambers;

a rear housing arranged on the side of said fixed scroll far from said movable scroll;

an intake pressure chamber formed as an outer spacing of said movable scroll for supplying a compressing gas into said pair of said compression chambers;

a discharge port formed at the central portion of said fixed scroll for discharging the gas compressed in said pair of said compression chambers;

a first bypass port adapted to open at a position on said base plate of said fixed scroll which is closed by said spiral wall of said movable scroll when one of said pair of compression chambers reaches a predetermined capacity ratio;

a second bypass port adapted to open at a position on said base plate of said fixed scroll which is closed by said spiral wall of said movable scroll when said other one of said pair of compression chambers reaches a predetermined capacity ratio;

a bypass slidably holding a valve spool inside thereof for establishing communication between said first bypass port and said second bypass port; and a return bypass for establishing communication between said bypass and said intake pressure chamber;

wherein said bypass is formed in linear form in said base plate of said fixed scroll and said return bypass is formed as a groove in at least one of said base plate of said fixed scroll and said rear housing between said fixed scroll and said rear housing.

13. A scroll-type variable-capacity compressor according to claim 12, wherein said return bypass is formed in said rear housing, and the sectional area of said return bypass in the direction of passage thereof is larger than the opening area of said first bypass port and said second bypass port.

14. A scroll-type variable-capacity compressor according to claim 12, wherein a valve spool is arranged in said bypass for opening and closing said first bypass port and said second bypass port, and said valve spool has at least two cylindrical portions for opening and closing said first bypass port and said second bypass port.

15. A scroll-type variable-capacity compressor according to claim 14, wherein said valve spool has a small-diameter portion between said two cylindrical portions, said small diameter portion being formed at a position adapted to face said bypass ports.

* * * * *